US005988087A

United States Patent [19]

Pepper

[11] Patent Number: 5,988,087

[45] Date of Patent: Nov. 23, 1999

[54] PONTOON FOR BOATS

[75] Inventor: Geoffrey T. Pepper, Junction City, Kans.

[73] Assignee: Horizon Marine, L.C., Junction City, Kans.

[21] Appl. No.: 09/124,588

[22] Filed: Jul. 29, 1998

[51] Int. Cl.[6] ..... B63B 1/00

[52] U.S. Cl. ..... 114/61.1; 114/61.2

[58] Field of Search ..... 114/123, 292, 114/61.1, 61.2, 61.26, 61.27

[56] References Cited

U.S. PATENT DOCUMENTS 4,738,215 4/1988 McMahon ..... 114/61.1
4,777,898 10/1988 Faulkner ..... 114/61.1
5,259,330 11/1993 Faulkner ..... 114/61.1
5,575,231 11/1996 Metcalf ..... 114/61.27

*Primary Examiner*—Stephen Avila
*Attorney, Agent, or Firm*—Hovey, Williams, Timmons & Collins

[57] ABSTRACT

A pontoon (20) for a boat (22) includes a base member (24) and a closure member (26) which are attached to form a U-shaped performance structure and a cylindrical support structure. A foam (74) filled nose cone (29) is connected to front ends (36,46) of the base member (24) and closure member (26), and an end cap (28) is connected to the back ends (38,48) thereof to form an air tight chamber (66) in the support structure. The pontoon (20) is connected to a deck (30) of the boat (22), so that the pontoon (20) contacts the deck (30) along the entire length of the pontoon (20).

20 Claims, 2 Drawing Sheets

PONTOON FOR BOATS

BACKGROUND OF THE INVENTION

This invention relates to watercraft and, more particularly, to flotation devices for boats.

Boating is one of Americans' favorite recreational activities, and many different types of watercraft have been created for different types of activities on the water. One of the most versatile craft is the pontoon boat which is capable of supporting activities ranging from barbeques to skiing. A typical pontoon boat includes a generally flat deck with a large passenger area surrounded at least in part by a railing. To keep the pontoon boat afloat, several flotation devices known as pontoons or logs are attached to the bottom of the deck.

Of the available pontoon structures, one of the strongest has a cylindrical configuration. Cylindrical pontoons are attached to the deck with brackets that are spaced apart along the length of the pontoon. This attachment leaves openings between the top of the pontoon and the bottom of the deck through which water flows during operation of the boat. Unfortunately, the flow of water over the cylindrical pontoon reduces performance.

Another structure utilizes a U-shaped pontoon contacting the deck over the entire length of the pontoon. This prevents water from flowing over the pontoon thereby enhancing performance. However, the U-shaped structure is not as strong as the cylindrical structure. For example, the U-shaped structure allows flexing in the pontoon walls.

Thus, it is desirable to increase the strength of pontoons while maintaining performance. Increasing strength extends the life of pontoons, and maintaining performance saves fuel and allows higher speeds for skiing and other tow activities.

BRIEF SUMMARY OF THE INVENTION

There is, therefore, provided in the practice of the invention a novel pontoon for boats which has a performance structure and a support structure combining to provide a strong, high performance pontoon. The pontoon includes a base member and a closure member connected to the base member. The base member has a downwardly convex bottom, and the closure member has an upwardly convex bottom which together form the support structure. A nose cone is connected to forward ends of the base and closure members.

In a preferred embodiment, the base member is U-shaped with a half-cylinder bottom, and the bottom of the closure member is also a half-cylinder. The base bottom and closure bottom form a cylindrical support structure while the U-shaped member forms the performance structure. The closure member also include closure legs adjacent to base legs of the base member, so that the closure legs and base legs form double walled legs of the U-shaped performance structure.

There is, therefore, further provided in the practice of the invention a novel pontoon boat. The pontoon boat includes a deck, propeller, railing, and a plurality of pontoons according to the present invention.

Accordingly, it is an object of the present invention to provide an improved pontoon for boats, the pontoon having enhanced strength and performance.

BRIEF DESCRIPTION OF THE DRAWINGS

These and other inventive features, advantages, and objects will appear from the following Detailed Description of The Preferred Embodiments when considered in connection with the accompanying drawings in which similar reference characters denote similar elements throughout the several views and wherein.

DETAILED DESCRIPTION OF THE PREFERRED EMBODIMENTS

Figures 1, 2, 3:
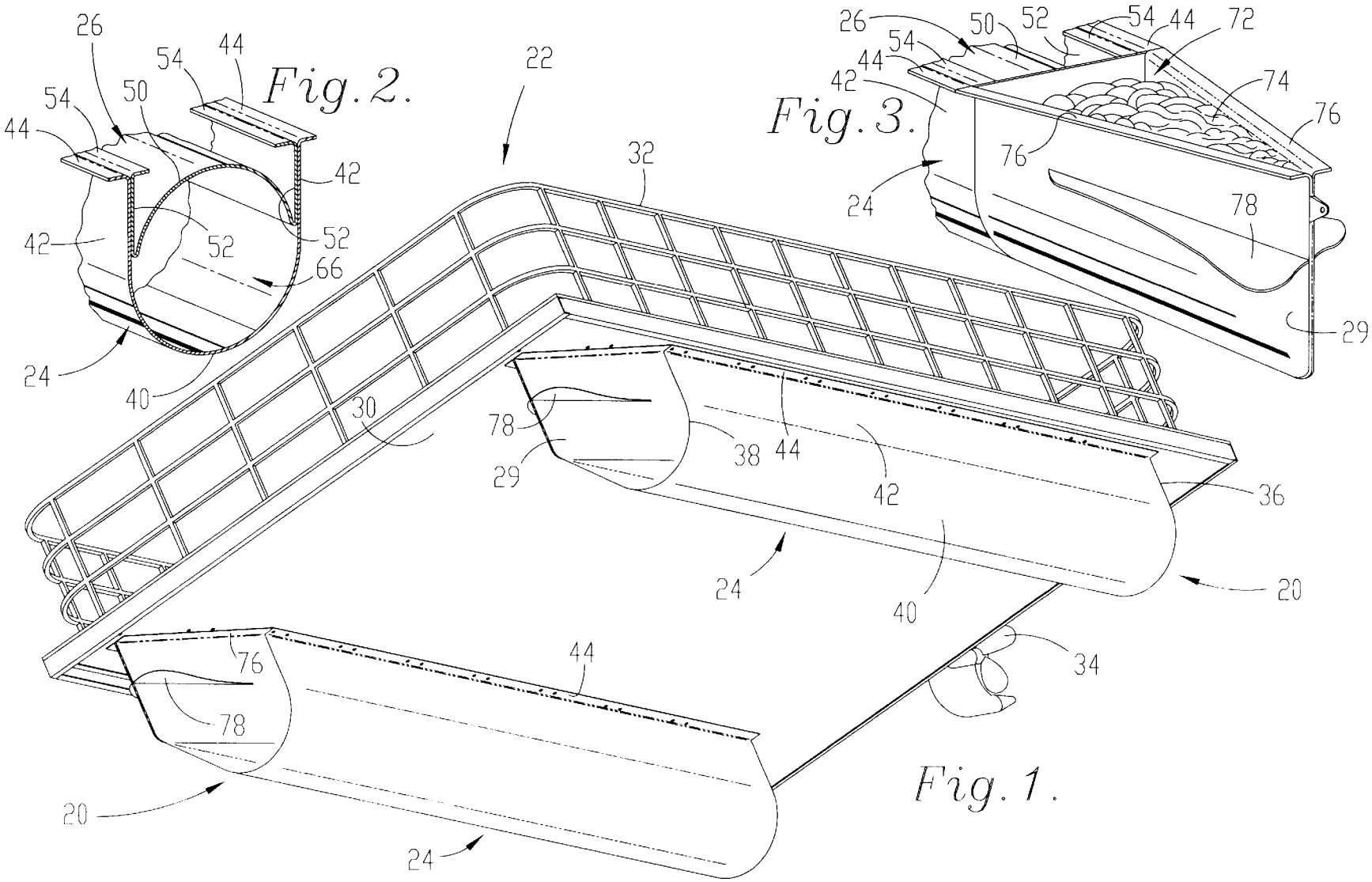
FIG. 1 is a bottom perspective view of a pontoon boat having a plurality of pontoons according to the present invention.
FIG. 2 is a fragmentary, perspective, transverse cross sectional view of a pontoon of FIG. 1.
FIG. 3 is a top fragmentary perspective of a pontoon of FIG. 1.

Referring to the drawings in greater detail, FIGS. 1 and 2 show a plurality of pontoons 20, preferably two, operatively connected to a watercraft 22 to make the watercraft more buoyant. The pontoons 20 are substantially similar and will generally be described throughout with reference to only one pontoon. The pontoon includes a base member 24, a closure member 26, a back end cap 28, and a nose cone 29. The base member 24 forms a generally outer performance structure which enhances the performance of the pontoon 20, and the base member 24 and closure member 26 combine to form a generally inner support structure which strengthens the pontoon.

Referring to FIG. 1, the watercraft 22, specifically a pontoon boat, includes a generally flat deck 30 having top and bottom sides. A rail 32 is attached to the top of the deck 30, and the pontoons 20 are attached to the bottom of the deck. A propeller 34 and a motor (not shown) are operatively coupled with the deck to move the boat 22 through water.

Figure 4:
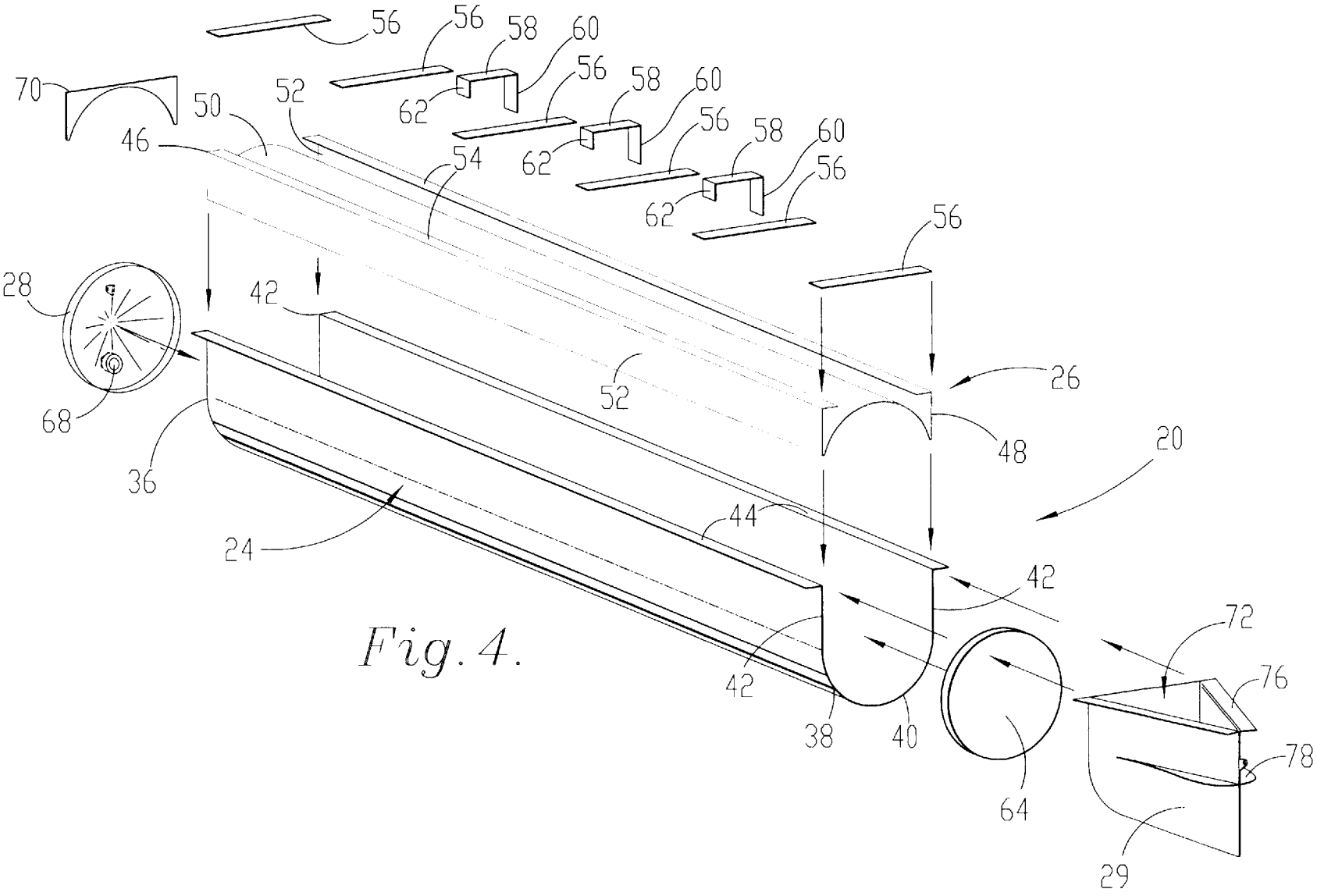
FIG. 4 is an exploded perspective view of a pontoon of FIG. 1.

Referring to FIGS. 2 and 4, the base member 24 is preferably U-shaped and elongated between a back end 36 and a forward end 38 and includes an arcuate base bottom 40 and a pair of opposed base legs 42. The base legs are substantially parallel to each other and are preferably planar. The base bottom is preferably a half-cylinder, and the base legs 42 tangentially connect with the base bottom 40. The base bottom 40 is downwardly convex, and together with the base legs 42 forms a generally outer, U-shaped performance structure. Base attachment flanges 44 extend transversely outward from the tops of the base legs 42 for attachment to the bottom of the deck 30. The base attachment flanges 44 are preferably constant along the length of the base member 24 and are substantially perpendicular to the base legs 42.

The closure member 26 is elongated between a back end 46 and a forward end 48 which coincide with the back and forward ends 36, 38 of the base member 24. The closure member includes a closure bottom 50 and an opposed pair of closure legs 52 which are substantially planar. The closure legs 52 connect to the closure bottom 50 substantially tangentially and are substantially parallel to each other and to the base legs 42. The closure bottom 50 is substantially arcuate and is preferably a half-cylinder that is upwardly convex. Closure attachment flanges 54 extend inwardly from the tops of the closure legs 52. The closure attachment flanges 54 are preferably constant along the length of the closure member 26 and are substantially perpendicular to the closure legs 52.

The closure member 26 is inserted into the base member 24 with the closure bottom 50 adjacent to the base bottom 40. The closure member and base member are connected, preferably with welds, to form a generally inner and substantially cylindrical support structure inside the generally outer and substantially U-shaped performance structure. Each of the closure legs is adjacent one of the base legs, and the closure legs are attached to the base legs to form double walled legs of the U-shaped performance structure. Further, the closure attachment flanges 54 and the base attachment flanges 44 are aligned in substantially the same plane.

To further strengthen the pontoon 20, a plurality, preferably six, cross braces 56 are connected to the pontoon and extend substantially perpendicular to the length of the pontoon. The cross braces 56 extend between the two closure legs 52 and are connected to the bottom sides of the closure attachment flanges 54. Also, middle brackets 58 are connected to at least some of the cross braces 56. The middle brackets include a long leg 60 and a short leg 62 which extend downwardly from the middle bracket 58 and connect to the closure bottom 50. Because of the different leg lengths, the middle brackets 58 are connected just to the side of the center of the cross braces 56.

The back end cap 28 is circular and is attached to the base bottom 40 and closure bottom 50 at the back ends 36, 46 thereof. A circular nose cone cap 64 of the nose cone 29 is attached to the base bottom and closure bottom at the forward ends 38, 48 thereof between the nose cone body 29 and the base and closure members. Thus, the base bottom 40, closure bottom 50, end cap 28, and nose cone cap 64 define a cylindrical internal chamber 66 in the support structure. The internal chamber 66 is preferably air tight. A drain plug 68 is provided in the back end cap 28 if any water finds its way into the cylindrical internal chamber 66.

Referring to FIGS. 3 and 4, the nose cone body 29 is generally triangular in configuration and is connected to the forward ends 38, 48 of the base and closure members. The nose cone also closes the forward end 48 of the closure member 26. A back plate 70 is attached the back end 36 of the closure member to close the back end of the closure member. The nose cone defines an internal chamber 72 which is preferably substantially filled with foam 74. The nose cone includes cone attachment flanges 76 for connection to the bottom of the deck 30. The nose cone 29 is also provided with spray deflectors 78 on the opposite sides thereof.

The U-shaped performance structure prevents water from flowing over the pontoon 20, and the cylindrical support structure significantly increases the strength of the pontoon. Further, the double walled legs inhibit flexing in the legs of the U-shaped structure. Thus, the pontoon 20 according to the present invention provides a high performance pontoon with increased strength.

Thus, a pontoon is disclosed which utilizes combined support and performance structures thereby enhancing both performance and strength. While preferred embodiments and particular applications of this invention have been shown and described, it is apparent to those skilled in the art that many other modifications and applications of this invention are possible without departing from the inventive concepts herein. It is, therefore, to be understood that, within the scope of the appended claims, this invention may be practiced otherwise than as specifically described, and the invention is not to be restricted except in the spirit of the appended claims. Though some of the features of the invention may be claimed in dependency, each feature has merit if used independently.

What is claimed is:

1. A pontoon for attachment to a watercraft to make the watercraft more buoyant, the pontoon comprising:

an elongated base member including a base forward end, a base back end, a downwardly convex base bottom, and a pair of opposed base legs connected to the base bottom;

an elongated closure member including a closure forward end, a closure back end, an upwardly convex closure bottom, and the closure member being connected to the base member with the closure bottom adjacent the base bottom to form a support structure; and a nose cone connected to the base and closure forward ends.

2. The pontoon according to claim 1 wherein the base bottom is substantially arcuate.

3. The pontoon according to claim 1 wherein the base member comprises a U-shaped base member.

4. The pontoon according to claim 1 wherein the base member further includes attachment flanges extending transversely from the base legs.

5. The pontoon according to claim 1 wherein the closure bottom is substantially arcuate.

6. The pontoon according to claim 1 wherein the closure member further includes a pair of opposed closure legs adjacent the base legs to form double walled legs.

7. The pontoon according to claim 1 further comprising a back end cap connected to the base and closure back ends to define an air tight chamber within the end cap, the nose cone, the base bottom, and the closure bottom.

8. The pontoon according to claim 1 wherein the support structure comprises a generally internal cylindrical support structure.

9. The pontoon according to claim 1 wherein the nose cone defines an internal chamber, and further comprising foam substantially filling the internal chamber.

10. A pontoon for attachment to a watercraft to make the watercraft more buoyant, the pontoon comprising:

an elongated and U-shaped base member including a downwardly convex, substantially half-cylinder base bottom and a pair of opposed substantially planar base legs substantially tangentially connecting with the half-cylinder bottom to form a U-shaped performance structure;

an elongated closure member including an upwardly convex, substantially half-cylinder closure bottom and a pair of opposed substantially planar closure legs substantially tangentially connecting with the closure bottom, and the closure member being connected to the base member with the closure bottom adjacent to the base bottom to form a support structure, and each of the closure legs adjacent one of the base legs; and a nose cone connected to forward ends of the base member and the closure member.

11. The pontoon according to claim 10 wherein the base legs are connected to the closure legs to form double walled legs of the U-shaped performance structure.

12. The pontoon according to claim 10 wherein the support structure comprises a substantially cylindrical shape.

13. The pontoon according to claim 10 further comprising a circular end cap connected to back ends of the base member and the closure member to form an air tight chamber defined by the nose cone, end cap, base bottom, and closure bottom.

14. The pontoon according to claim 10 further comprising a plurality of cross braces extending substantially perpendicular to a length of the closure member, and the cross braces being connected to the closure legs.

15. A pontoon boat including a generally flat deck having a top and a bottom, a rail attached to the top of the deck, a propeller operatively coupled with the deck to move the boat through water, and a plurality of pontoons attached to the bottom of the deck, at least one of the pontoons comprising:

an elongated base member including a base forward end, a base back end, a downwardly convex base bottom, and a pair of opposed base legs connected to the base bottom;

an elongated closure member including a closure forward end, a closure back end, an upwardly convex closure bottom, and the closure member being connected to the base member with the closure bottom adjacent the base bottom to form a support structure; and a nose cone connected to the base and closure forward ends.

16. The pontoon boat according to claim 15 wherein the base member comprises a U-shaped base member forming a generally outer U-shaped performance structure, and the base bottom and closure bottom comprise substantially half circles forming a generally inner and substantially cylindrical shaped support structure.

17. The pontoon boat according to claim 16 wherein legs of the U-shaped performance structure comprise double walled legs including the base legs and a pair of closure legs connected to the closure bottom.

18. The pontoon boat according to claim 15 wherein each of the pontoons comprises:

an elongated base member including a base forward end, a base back end, a downwardly convex base bottom, and a pair of opposed base legs connected to the base bottom;

an elongated closure member including a closure forward end, a closure back end, an upwardly convex closure bottom, and the closure member being connected to the base member with the closure bottom adjacent the base bottom to form a secondary support structure;

a nose cone connected to the base and closure forward ends; and an end cap connected to the base back end and the closure back end forming an air tight chamber in the support structure.

19. The pontoon boat according to claim 18 further comprising a drain plug in the end cap, and wherein the nose cone comprises a generally triangular configuration and includes spray deflectors.

20. The pontoon boat according to claim 15 further comprising a front end cap connected to the base bottom and closure bottom at the respective forward ends thereof.

* * * * *